US009589687B2

(12) United States Patent
Olma et al.

(10) Patent No.: US 9,589,687 B2
(45) Date of Patent: Mar. 7, 2017

(54) CONTROLLING THE TEMPERATURE OF URANIUM MATERIAL IN A URANIUM ENRICHMENT FACILITY

(71) Applicant: URENCO Limited, Stoke Poges (GB)

(72) Inventors: Sebastian Olma, Munster (DE); Ferdinand Rose, Bad Bentheim (DE)

(73) Assignee: URENCO Limited, Buckinghamshire (GB)

( * ) Notice: Subject to any disclaimer, the term of this patent is extended or adjusted under 35 U.S.C. 154(b) by 38 days.

(21) Appl. No.: 14/604,943

(22) Filed: Jan. 26, 2015

(65) Prior Publication Data

US 2015/0213911 A1 Jul. 30, 2015

(30) Foreign Application Priority Data

Jan. 27, 2014 (EP) ..... 14400005

(51) Int. Cl.

| | |
|---|---|
| ***G21F 5/10*** | (2006.01) |
| ***G21F 5/015*** | (2006.01) |
| ***G21F 9/02*** | (2006.01) |
| ***G21F 9/28*** | (2006.01) |
| ***G21F 5/002*** | (2006.01) |

(52) U.S. Cl.

CPC ..... *G21F 5/10* (2013.01); *G21F 5/002* (2013.01); *G21F 5/015* (2013.01); *G21F 9/02* (2013.01); *G21F 9/28* (2013.01)

(58) Field of Classification Search

USPC ..... 250/505.1, 506.1, 526; 423/3, 249, 253; 432/4, 5, 28, 30, 31; 376/180, 181, 191, 376/247, 260, 272, 463; 588/1, 17, 260, 588/261; 210/682

See application file for complete search history.

(56) References Cited

U.S. PATENT DOCUMENTS 4,302,427 A * 11/1981 Berry ..... C01B 15/0475 210/634
4,497,775 A * 2/1985 McMullen ..... C01B 3/0005 376/146
4,672,213 A * 6/1987 Stoll ..... G21F 5/005 250/506.1
4,730,663 A * 3/1988 Volkl ..... F28B 9/06 165/104.14

(Continued)

FOREIGN PATENT DOCUMENTS

JP 05-180987 A 7/1993
JP 05180987 B2 4/2013

OTHER PUBLICATIONS

Communication in EP14400005.6 dated Jul. 24, 2014, with European Search Report dated Jul. 18, 2014.

*Primary Examiner* — Bernard Souw
(74) *Attorney, Agent, or Firm* — Banner & Witcoff, Ltd.

(57) ABSTRACT

An apparatus arranged to control the temperature of uranium material in a uranium material storage container, comprising a thermal guide which wraps around an external surface of the uranium material storage container to cause the uranium material storage container to exchange heat energy with a heat transfer medium inside the thermal guide and a heat exchanger to heat or cool the heat transfer medium outside the thermal guide. A method of controlling the temperature of uranium material in a uranium material storage container is also described.

18 Claims, 6 Drawing Sheets

(56) References Cited

U.S. PATENT DOCUMENTS

| | | | | |
|---|---|---|---|---|
| 4,891,192 | A * | 1/1990 | Sarda | G21F 9/02<br>210/682 |
| 5,826,163 | A | 10/1998 | Saraceno et al. | |
| 6,010,671 | A * | 1/2000 | Kimura | C01G 43/00<br>423/3 |
| 6,183,243 | B1 | 2/2001 | Snyder | |
| 2007/0178036 | A1 * | 8/2007 | Takahashi | C01G 43/00<br>423/253 |
| 2011/0206173 | A1 * | 8/2011 | Walters | G21C 1/02<br>376/264 |
| 2015/0078504 | A1 * | 3/2015 | Woolley | G21G 1/001<br>376/100 |

* cited by examiner

CONTROLLING THE TEMPERATURE OF URANIUM MATERIAL IN A URANIUM ENRICHMENT FACILITY

FIELD

This specification relates to controlling the temperature of a uranium material in a uranium enrichment cycle and particularly, but not exclusively, to controlling the temperature of uranium hexafluoride (UF6) inside industry-standardized 48Y and 30B UF6 cylinders in a uranium enrichment facility.

BACKGROUND

In a uranium enrichment facility, uranium material is heated and cooled in industry-standardized transport cylinders before and after being fed through the enrichment apparatus.

SUMMARY

This specification provides an apparatus arranged to control the temperature of uranium material in a uranium material storage container, comprising a thermal guide which wraps around an external surface of the uranium material storage container to cause a heat transfer medium inside the thermal guide to exchange heat energy with the uranium material storage container; and a heat exchanger to heat or cool the heat transfer medium outside the thermal guide.

The thermal guide may form a thermally conductive contact with the uranium material container to cause the exchange of heat energy by conduction.

The exchange of heat energy may increase or decrease the temperature of the uranium material.

The thermal guide may be configured to guide the heat transfer medium around the exterior of the uranium material container.

The apparatus may be configured to cause the heat transfer medium to flow between the thermal guide and the heat exchanger.

The thermal guide may surround the uranium material container.

The thermal guide may comprise a thermally conductive heat transfer surface for locating against the external surface of the uranium material container and through which heat energy is exchanged between the heat transfer medium in the guide and the uranium material container.

The thermal guide may comprise a heat insulating surface which is configured to prevent heat transfer between the heat transfer medium in the guide and the atmosphere around the uranium material container.

The apparatus may be configured to controllably heat or cool the heat transfer medium in order to cause heating or cooling of the uranium material inside the uranium material container.

The apparatus may be configured to detect the temperature of the uranium material container and to heat or cool the heat transfer medium in response to the detected value of the temperature of the uranium material container.

The apparatus may be configured to heat or cool the heat transfer medium to obtain a predetermined target temperature for the uranium material container.

The target temperature may be sufficient to cause the uranium material inside the uranium material container to change material state.

The apparatus may be arranged to circulate the heat transfer medium between the thermal guide and the heat exchanger to heat or cool the heat transfer medium.

The thermal guide may be selectively attachable to, and/or releasable from, the exterior of the uranium material container.

The apparatus may comprise quick-release connections which allow the thermal guide to be selectively attached to, and/or released from, the uranium material container.

The quick-release connections may comprise magnetic connections which attach the thermal guide to the uranium material container.

The quick-release connections may comprise mechanical clamps which attach the thermal guide to the uranium material container.

The thermal guide may comprise a plurality of sections which wrap around a corresponding plurality of regions of the uranium material container.

The heat transfer medium may be a liquid.

The heat transfer medium may be a gas.

This specification also provides a uranium material storage container wrapped in the thermal guide.

The apparatus may comprise a further thermal guide which wraps around an external surface of a further uranium material storage container to cause a heat transfer medium inside the further thermal guide to exchange heat energy with the further uranium material storage container, wherein the heat exchanger is configured to transfer heat energy extracted from the warmer storage container to the cooler storage container.

This specification also provides a method of controlling the temperature of uranium material in a uranium material storage container, comprising wrapping the uranium material storage container in a thermal guide; and heating or cooling a heat transfer medium outside the thermal guide to cause the heat transfer medium to exchange heat energy with the uranium material storage container when inside the guide.

BRIEF DESCRIPTION OF THE DRAWINGS

Embodiments of the invention are described below, for the purposes of example only, with reference to the accompanying drawings in which.

DETAILED DESCRIPTION

Figure 1:
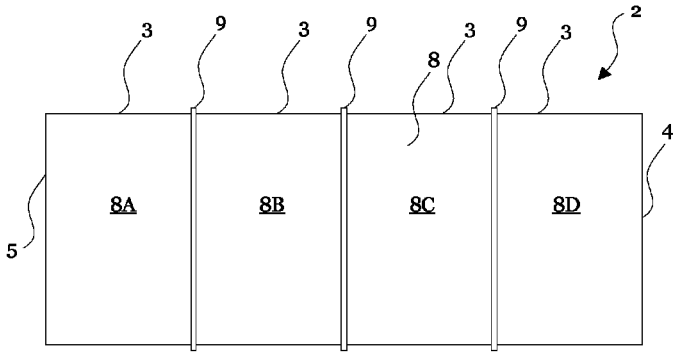
FIG. 1 is an illustration of the side of a 48Y UF6 storage and transport cylinder.

A thermal energy transfer apparatus 1 for safely heating and cooling uranium hexafluoride (UF6) in a uranium enrichment facility is described below. The apparatus 1 is adapted to heat and cool the UF6 inside industry-standardized uranium material containers 2 that have been manufactured and certified according to ISO and ANSI specifications. The examples below discuss the containers 2 in the context of 48Y UF6 cylinders 2 and 30B UF6 cylinders 2. Both of these types of cylinder 2 can be used to contain UF6 at depleted, natural or enriched concentrations of U235.

When industry-standardized UF6 containers 2 are exposed to normal atmospheric temperatures, for example during long term storage and transportation, the conditions inside the containers 2 are such that the UF6 is in a solid state, with a vapour pressure of approximately 100 mbar. The thermal energy transfer apparatus 1 described herein is arranged to convert UF6 inside the containers 2 from a solid state to a gaseous state when being fed from the containers 2 into a uranium enrichment apparatus, such as a cascade of gas centrifuges.

The thermal energy transfer apparatus 1 is also arranged to convert enriched and depleted UF6 products of the enrichment apparatus from a gaseous state back into a solid state inside the containers 2. As explained in detail below, the thermal energy transfer apparatus 1 effects the conversions in the state of the UF6 by conducting heat energy into and out of the walls of the containers 2 in a safe and energy efficient manner.

Figure 2:
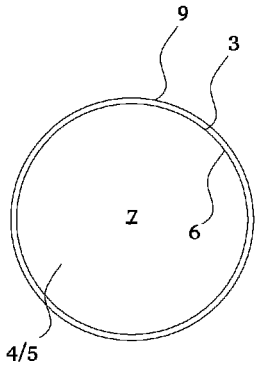
FIG. 2 is an illustration of the end of a 48Y UF6 storage and transport cylinder.

Referring to FIGS. 1 and 2, an industry-standardized UF6 container 2 is approximately cylindrical in shape and comprises a longitudinal wall 3 and two end walls 4, 5. The end walls 4, 5 are located at opposite ends of the container 2 and the cylindrical longitudinal wall 3 extends between them. The perimeter 6 of each end wall 4, 5 is approximately circular and is joined to the cylindrical longitudinal wall 3. The exteriors of the end walls 4, 5 form the exterior end surfaces 7 of the container 2, and the exterior of the longitudinal wall 3 forms the exterior longitudinal surface 8 of the container 2. In FIG. 1, the external diameter of the container 2 is illustrated as being approximately constant along the container's length. However, the skilled person will be aware that in some types of standardized UF6 container 2 the diameter of the container 2 narrows towards either end. The walls 3, 4, 5 of the container 2 are thermally conductive and thus allow heat energy to be transferred into and out of the UF6 material through the walls 3, 4, 5.

The longitudinal wall 3 includes a plurality of circumferential stiffening ribs 9 which extend around the cylinder 2 at regular intervals along its length. The orientation of the ribs 9 is approximately parallel to the end walls 4, 5 of the cylinder 2, such that the ribs 9 project outwardly in a direction that is approximately perpendicular to the surface 8 of the longitudinal wall 3. The ribs 9 divide the exterior surface 8 of the longitudinal wall 3 into a plurality of cylindrical sections 8A-D. The boundaries of each section 8A-D are defined either by a pair of ribs 9 or by a rib 9 on one side and an end of the cylinder 2 on the other side. The cylindrical wall sections 8A-D each extend fully around the circumference of the UF6 cylinder 2 and may be approximately equal in length. For example, the UF6 cylinder 2 illustrated in FIG. 1 comprises three circumferential ribs 9 that, together, divide the longitudinal exterior surface 8 of the cylinder 2 into four cylindrical sections 8A-D.

Figure 3:
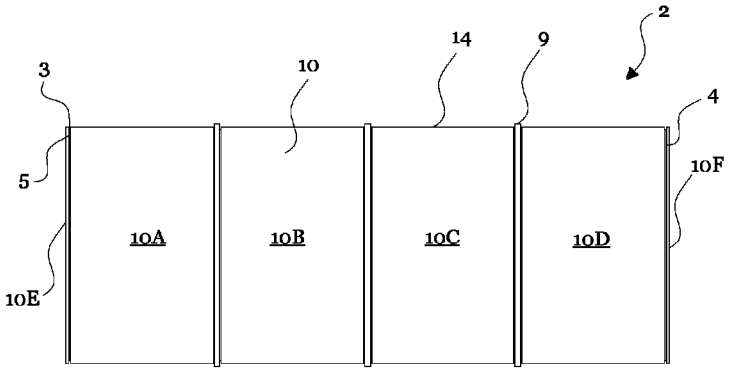
FIG. 3 is an illustration of the side of a 48Y UF6 storage and transport cylinder wrapped in a thermal guide.
Figure 4:
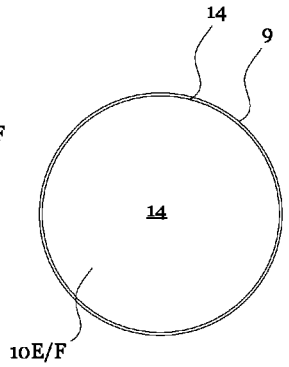
FIG. 4 is an illustration of the end of a 48Y UF6 storage and transport cylinder wrapped in a thermal guide.

FIGS. 3 and 4 illustrate an industry-standardized 48Y UF6 cylinder 2 in thermal contact with the thermal energy transfer apparatus 1. More specifically, in FIGS. 3 and 4, the exterior surfaces 7, 8 of the UF6 cylinder 2 are in contact with a thermal guide 10 of the thermal energy transfer apparatus 1. The thermal guide 10 is flexible in shape and is wrapped around the UF6 cylinder 2 so that the exterior surfaces 7, 8 of the UF6 cylinder 2 are encompassed by the guide 10. As explained below, the guide 10 contains a heat transfer medium 11 which exchanges heat energy with the UF6 through the walls 3, 4, 5 of the UF6 cylinder 2 to change the material state of the UF6 pre and post enrichment.

Figure 5:
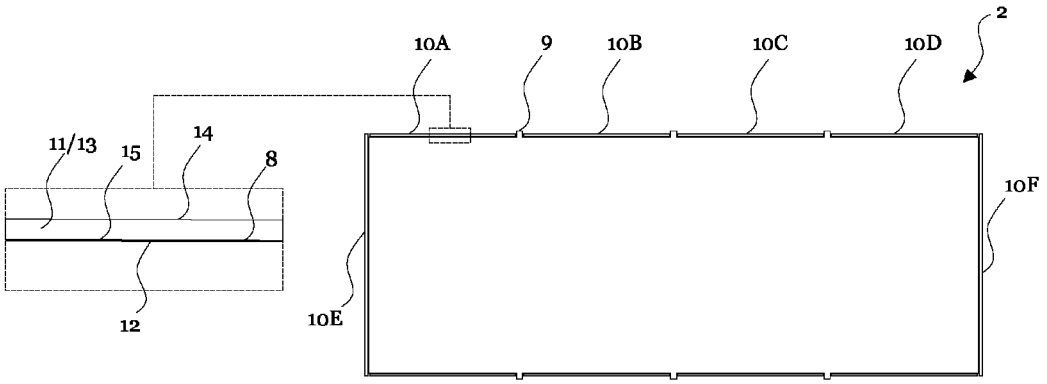
FIG. 5 is a cross-sectional illustration of a thermal guide in thermally conductive contact with the exterior of a 48Y UF6 storage and transport cylinder.

Referring to FIG. 5, the guide 10 comprises a heat transfer surface 12, a heat transfer medium containing region 13 and a heat insulating surface 14. The heat transfer medium containing region 13 is located in the interior of the guide 10, between the heat transfer surface 12 and the heat insulating surface 14. Both surfaces 12, 14 of the guide 10 are impermeable to the heat transfer medium 11. This prevents contact between the heat transfer medium 11 and the exterior surfaces 7, 8 of the UF6 cylinder 2. It also prevents contact between the heat transfer medium 11 and the atmospheric air around the outside of the guide 10.

The heat transfer surface 12 is located against the external surfaces 7, 8 of the UF6 cylinder 2 and is thermally conductive. It may, for example, comprise the surface of a flexible, thermally permeable membrane 15 at the exterior of the guide 10. The thermally permeable membrane 15 may be elastic in order to ensure a consistent thermally conductive contact with the exterior surfaces 7, 8 of the UF6 cylinder 2. The thermally conductive contact between the heat transfer surface 12 and the exterior surfaces 7, 8 of the UF6 cylinder 2 causes heat energy to conduct through the heat transfer surface 12 between the heat transfer medium 11 and the exterior walls 3, 4, 5 of the cylinder 2. The rate and direction of the heat conduction is dependent on the temperature gradient between the heat transfer medium 11 in the guide 10 and the external surfaces 7, 8 of the UF6 cylinder 2. Therefore, as described in more detail below, the rate and direction of thermal energy transfer between the UF6 in the cylinder 2 and the heat transfer medium 11 in the guide 10 can be controlled by controlling the temperature of the heat transfer medium 11.

The heat transfer surface 12 follows the external contours of the cylinder 2 so that the nature of its contact with the exterior surfaces 7, 8A-D is continuous and encompassing. For example, as illustrated in FIGS. 3 and 4, the thermal guide 10 may extend around the full circumference of the cylinder 2 so that the heat transfer surface 12 is in contact with the exterior surface 8 of the longitudinal wall 3 around the full circumference of the wall 3. The length and width of the guide 10 are matched specifically with the corresponding dimensions of the cylinder 2 so as to provide an uninterrupted contact with the external surfaces 7, 8 of the cylinder 2. The thickness of the guide 10, i.e. the distance between the heat transfer surface 12 and the heating insulating surface 14, may be between approximately 1 cm and approximately 5 cm, such as between approximately 2 cm and approximately 3 cm.

The continuous contact between the external surfaces 7, 8 of the cylinder 2 and the heat transfer surface 12 allows thermal energy to be conducted between the heat transfer medium 11 and the UF6 cylinder 2 over a high proportion of the total external surface 7, 8 of the cylinder 2. The conductive nature of the thermal exchange and the encompassing nature of the guide 10 around the cylinder 2 may provide for a high degree of efficiency in the thermal energy transfer and thus lower the amount of energy required for the UF6 to be cooled or heated, as desired. The conductive thermal exchange and encompassing nature of the guide 10 may also allow for the temperature of the cylinder 2 to be changed rapidly and thus controlled with a high degree of accuracy.

The heat insulating surface 14 is located on the opposite side of the guide 10 to the heat transfer surface 12 so that it faces outwards from the cylinder 2. The heat insulating surface 14 is not thermally conductive and therefore substantially prevents heat energy from being exchanged between the air around the outside of the guide-wrapped cylinder 2 and the heat transfer medium 11 in the guide 10. The thermally insulating nature of the insulating surface 14 may further increase the efficiency of the thermal energy transfer between the heat transfer medium 11 and the UF6 cylinder 2.

Figure 6:
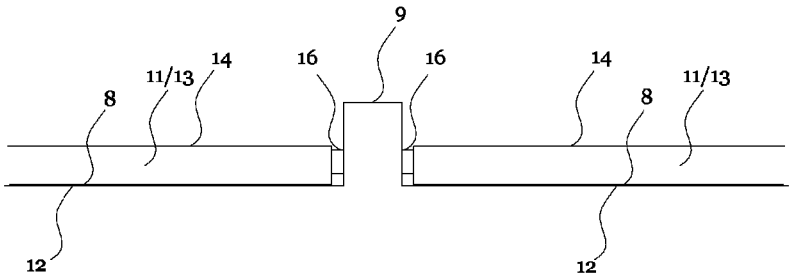
FIG. 6 is a schematic illustration of quick-release connections between a thermal guide and the exterior of a 48Y UF6 storage and transport cylinder.

The flexible nature of the thermal guide 10 allows it to be added to the UF6 cylinder 2 by wrapping it around the exterior surfaces 7, 8 of the cylinder 2. Similarly, the flexible nature of the thermal guide 10 allows it to be removed from the UF6 cylinder 2 by unwrapping it from the exterior surfaces 7, 8 of the cylinder 2. In this way, the thermal guide 10 can be selectively attached to, and released from, the UF6 cylinder 2. The addition and removal of the guide 10 to and from the cylinder 2 can be rapidly achieved because the guide 10 is connected to the cylinder 2 using quickly attachable and releasable connectors 16, as illustrated in FIG. 6. These connectors 16 may, for example, secure the guide 11 directly to sections of the exterior surfaces 7, 8 of the cylinder 2. Additionally or alternatively, as illustrated in FIG. 6, the connectors 16 may secure the guide 10 to the ribs 9. This is convenient because it avoids any disruption that could be caused by the connectors 16 to the thermally conductive contact between the heat transfer surface 12 and the longitudinal exterior surfaces 7, 8 of the UF6 cylinder 2. The connectors 16 may be magnetic connectors 16. For example, the guide 10 may comprise magnetic regions 16 which magnetically adhere to the carbon-steel material of a 48Y or 30B UF6 cylinder 2. Alternatively, the connectors 16 may comprise another type of releasable fixing such as releasable clamps.

In some embodiments, for example when the UF6 cylinder 2 comprises the ribs 9 shown in FIG. 1, the guide 10 comprises a plurality of separate longitudinal sections 10A-D. These longitudinal sections 10A-D comprise a plurality of separate lengths of the guide 10 that are respectively wrapped around different cylindrical sections 8A-D of the longitudinal surface 8 of the cylinder 2. An example of this is illustrated in FIG. 3. The dimensions of the guide sections 10A-D match those of the cylindrical sections 8A-D of the cylinder 2 that they are intended to cover so that only the ribs 9 of the cylinder 2 remain exposed.

The guide 10 may additionally or alternatively comprise two separate end sections 10E-F, which respectively cover the end surfaces 7 of the cylinder 2. An example of this is illustrated in FIG. 4. As with the separate longitudinal sections 10A-D described above, and the guide 10 generally, the dimensions of the end sections 10E-F of the guide 10 match those of the surfaces 7 of the cylinder 2 that they are intended to cover. In this way, the guide 10 covers substantially the complete external surface 7, 8 of the cylinder 2. The guide sections 10A-F can each be added to and removed from the cylinder 2 separately from one another using the magnetic connections 16 referred to above.

The guide 10 is re-usable and so, in the uranium enrichment facility, the guide 10 can be used to heat or cool a plurality of UF6 cylinders 2 in sequential order. A plurality of the guides 10 can thus be used to provide a consistent supply of heated UF6 material for enrichment and a correspondingly consistent cooling of UF6 material received from the enrichment apparatus post enrichment. For example, once a particular one of the guides 10 has been used to heat the UF6 material in a particular (e.g. 48Y) cylinder 2 to the desired temperature for use in the next stage of the uranium enrichment process, the guide 10 can be removed from the cylinder 2 by releasing the connections 16 referred to above and unwrapping it from the cylinder's surface 7, 8. The guide 10 can then be attached to another (e.g. 48Y) cylinder 2 in order to heat the UF6 inside the new cylinder 2 in the same manner as the previous cylinder 2. The process may be repeated as often as is necessary to provide the desired rate of gaseous UF6 for use in the next stage of the enrichment cycle.

Similarly, once a guide 10 has been used to cool a (e.g. 30B) cylinder 2 of post enrichment UF6 to the desired temperature, causing the UF6 to convert from a gaseous state back to a solid state, the guide 10 can be removed from the cylinder 2 and attached to another (e.g. 30B) cylinder 2 to cool another quantity of post enrichment UF6 in the same manner.

The weight of the guide 10 is such that it can be attached to and removed from the UF6 cylinders 2 by a human operator. For example, the mass of each section 10A-F of the guide 10 may be between approximately 5 kg and approximately 20 kg, such as between approximately 10 kg and approximately 15 kg.

The heat transfer medium 11 is a fluid in either liquid or gaseous form. For example, the heat transfer medium 11 may be air or a medium with a higher heat capacity such as water or glycol. As described below, the thermal energy transfer apparatus 1 is configured to control the temperature of the heat transfer fluid 11 in order to control the flow of heat energy through the heat transfer surface 12 and thereby to accurately control the temperature of the UF6 inside the UF6 cylinder 2.

Figure 7:
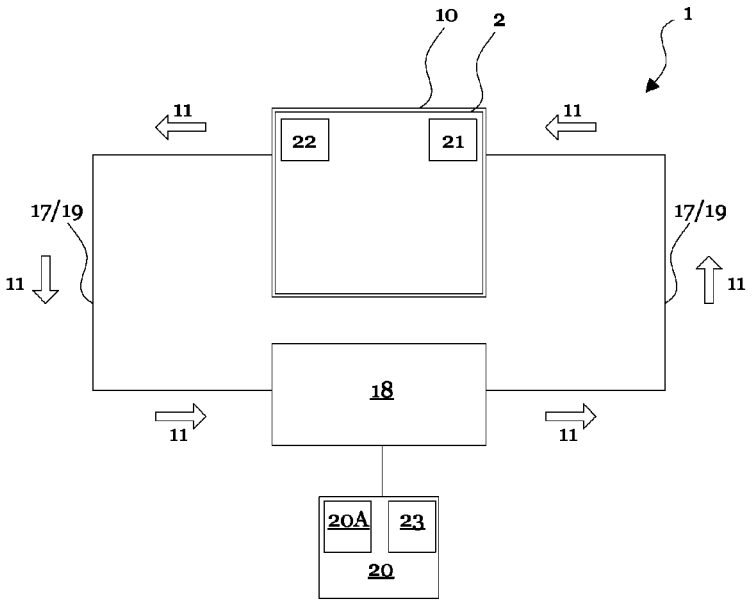
FIG. 7 is a schematic illustration of a heat exchange loop in which a heat transfer fluid flows around a looped circuit containing a heat exchanger and a thermal guide wrapped around a UF6 storage and transport cylinder.

Referring to FIG. 7, the temperature of the heat transfer fluid 11 is controlled by causing the heat transfer fluid 11 to continuously flow through a looped heat exchange path 17. The looped path 17 comprises a fluid channel circuit, which includes the heat transfer medium containing region 13 in the guide 10 and a heat exchanger 18 outside the guide 10. The heat exchanger 18 may, for example, be located in the hall which houses the UF6 take-off and/or feed-stations for the enrichment apparatus. The heat exchanger 18 may be configured to draw heat energy from, and/or expel heat energy to, the external atmosphere around the heat exchanger 18, such as that in or outside the hall, in order to heat or cool the heat transfer fluid 11 as required. The heat exchanger 18 may, for example, comprise a heat pump 18. The heat transfer fluid 11 is continuously directed around the circuit from the heat exchanger 18 to the containing region 13 of the guide 10 and then back to the heat exchanger 18. A suitable fluid pump (not shown) may be used to circulate the heat transfer fluid 11.

Figure 8:
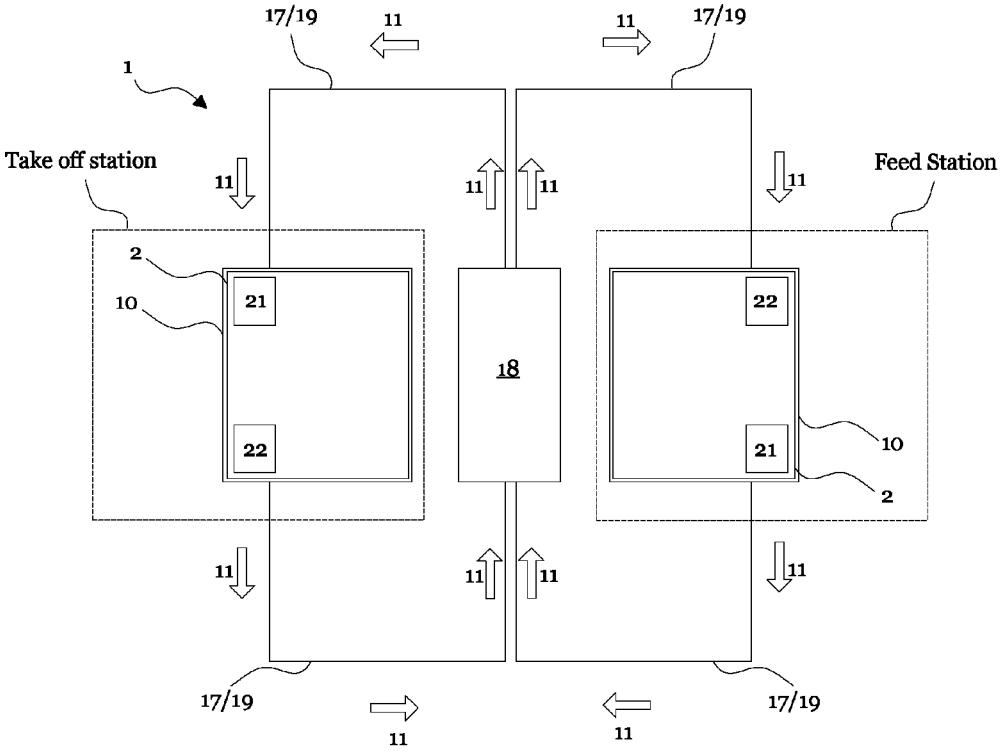
FIG. 8 is a schematic illustration of separate heat exchange loops of a UF6 take-off station and a UF6 feed station served by a heat exchanger coupled to both loops.

Referring to FIG. 8, the heat exchanger 18 may be coupled to fluid channel circuits 17 of both a UF6 feed station, in which one or more UF6 cylinders 2 are heated to feed gaseous UF6 to the enrichment apparatus, and a UF6 take-off station, in which one or more UF6 cylinders 2 are cooled to solidify gaseous UF6 taken-off from the enrichment apparatus. For example, the heat exchanger 18 may be configured to extract heat energy from heat transfer fluid 11 in the fluid channel circuit 17 of the UF6 take-off station and to add heat energy to heat transfer fluid 11 in the fluid channel circuit 17 of the UF6 feed station. The heat exchanger 18 may be configured to transfer the heat energy that is extracted from the heat transfer fluid 11 in the circuit 17 of the UF6 take-off station into the heat transfer fluid 11 in the circuit 17 of the UF6 feed station.

In this way, the heat transfer fluid 11 in the take-off station circuit 17 is cooled at the heat exchanger 18 in order to cause the fluid 11 to cool UF6 cylinders 2 in the take-off station. Conversely, the heat transfer fluid 11 in the feed station circuit 17 is heated at the heat exchanger 18 in order to cause the fluid 11 to heat UF6 cylinders 2 in the feed station. The thermal energy used to heat the heat transfer fluid 11 in the feed station circuit 17 is thereby at least partially drawn from the high temperature UF6 being received at the take-off station from the enrichment apparatus. The extraction of heat energy from the high energy UF6 in the take-off station for use in heating the low energy UF6 in the feed-station makes the heating and cooling process both energy efficient and environmentally advantageous because the heat energy extracted from the UF6 in the take-off station is not wastefully expelled to the open atmosphere.

It will be appreciated that the exchange of heat energy in the heat exchanger 18 may be used to maintain, rather than to substantially increase or decrease, the temperatures of the UF6 cylinders 2 in the UF6 take-off and feed stations and/or the temperature of the heat transfer fluid 11 in the fluid circuits 17. The transfer of heat energy between one or more UF6 cylinders 2 in one or more feed stations and one or more UF6 cylinders 2 in one or more take-off stations, as described above, may be used to achieve such a temperature maintenance effect.

Figure 9:
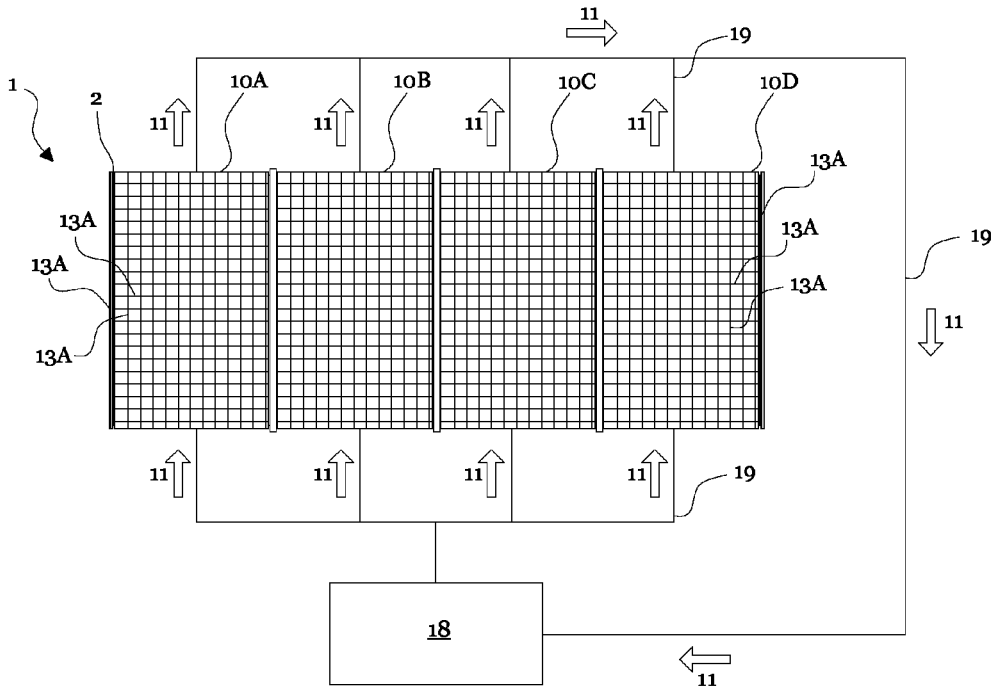
FIG. 9 is a schematic illustration of heat exchange paths within a thermal guide wrapped around a 48Y UF6 storage and transport cylinder.

Referring to FIG. 9, the heat transfer medium containing region 13 of the guide 10 may comprise one or more fluid channels 13A in thermally conductive contact with the thermally permeable membrane 15 located against the external surfaces 7, 8 of the cylinder 2. For example, in operation, the heat transfer fluid 11 may be piped along a circulation line 19 from the heat exchanger 18 into the guide 10 and divided amongst a plurality of heat transfer tubes 13A that together direct the heat transfer fluid 11 to all regions of the guide 10 before it is piped back along the circulation line 19 to the heat exchanger 18. The even distribution of the tubes 13A in the guide 10 provides a correspondingly even level of heat exchange over the external surface area 7, 8 of the UF6 cylinder 2.

In the case where the thermal guide 10 comprises a plurality of individual sections 10A-F of the type described above, each of the sections 10A-F may comprise a plurality of such fluid channels 13A.

Alternatively, the heat transfer medium containing region 13 may comprise a cavity which is bounded by the walls of the thermal guide 10. The cavity may be substantially uninterrupted across the area of the guide 10 so that the heat transfer fluid 11 piped into the cavity via the circulation line 19 fills the cavity and causes heat exchange to take place evenly over the surfaces 7, 8 of the cylinder 2. If the guide 10 comprises a plurality of sections 10A-F, as described above, then each section 10A-F may comprise its own cavity which is individually filled by fluid 11 piped from the heat exchanger 18.

As illustrated in FIG. 7, the heat exchanger 18 is communicatively coupled to a controller 20, such as an electronic microcontroller 20, which is configured to control the operation of the heat exchanger 18. In particular, the controller 20 is configured to control the rate and direction of the flow of heat energy into or out of the heat transfer fluid 11 in the heat exchanger 18 in order to control the temperature of the fluid 11 and, in doing so, to control the temperature of the UF6 material inside the cylinder 2.

In order to do this, the controller 20 may store in a memory 20A a target temperature for the interior of the UF6 cylinder 2 and cause the heat exchanger 18 to transfer heat energy into and/or out of the heat transfer fluid 11 in order to obtain and/or maintain the target temperature inside the UF6 cylinder 2. The controller 20 may continuously or regularly monitor the temperature of the cylinder 2 using one or more temperature sensors 21 on the cylinder 2. The temperature sensors 21 are communicatively coupled to the controller 20 to communicate temperature measurements to the controller 20. The controller 20 uses the temperature measurements from the sensors 21 to vary the operation of the heat exchanger 18 in order to achieve an appropriate rate of heating or cooling. For example, if the temperature sensed by the sensors 21 is below the target temperature for the UF6 cylinder 2, the controller 20 may cause the heat exchanger 18 to direct more heat energy into the heating fluid 11 to increase its temperature. Likewise, if the temperature inside the cylinder 2 is sensed by the sensors 21 to be above the target temperature, the controller 20 may cause the heat exchanger 18 to remove heat energy from the heating fluid 11 to decrease its temperature.

The cylinder 2 may also comprise one or more pressure sensors 22 that are configured to determine the internal pressure of the cylinder 2 and are communicatively coupled to the controller 20 to communicate pressure measurements to the controller 20. The controller 20 uses the pressure measurements to monitor the internal pressure of the cylinder 2 to ensure that it correlates with an expected pressure value stored in the memory 20A. For example, the controller 20 may use the pressure measurements to ensure that the pressure of the cylinder 2 is in the region of 400 mbar.

The target temperature stored at the controller 20 for the UF6 cylinder 2 is set so as to cause the UF6 inside the cylinder 2 to change state between gas and solid as required. For example, during heating of the UF6 material pre-enrichment, the controller 20 may be configured to cause the UF6 material to be heated to a temperature of between 40° C. and 60° C., such as approximately 55° C., in order to cause the UF6 inside the cylinder 2 to change from solid to gas inside the cylinder 2. If, as intended, the thermal energy transfer apparatus 1 is used in open environments where the UF6 cylinder 2 is not contained in a sealed system, the controller 20 is configured to limit the temperature of the UF6 to values below its triple point temperature of 64° C. for safety reasons. For example, the controller 20 and heat exchanger 18 may be configured to ensure that the temperature of the heat transfer fluid 11 also remains below 64° C. by implementing a temperature-based cut-off in the heat exchanger 18.

During cooling of the UF6 material post enrichment, the controller 20 may be configured to cause the UF6 material to be cooled to a temperature below 40° C. An example temperature is between 20° C. and −25° C., although the apparatus 1 could be used to cool the UF6 to lower temperatures if desired.

The target temperature is user controllable and can be set by inputting a command to the controller 20 via a user interface 23 of the thermal energy transfer apparatus 1. For example, the apparatus 1 may comprise a control panel 23 through which the commands can be entered.

In addition to the temperature of the UF6 cylinder 2, the controller 20 may also monitor the temperature of the heat transfer fluid 11 directly in order to allow it to effect accurate temperature adjustments to the fluid 11 at the heat exchanger 18. In this way, the controller 18 can make correspondingly accurate adjustments to the temperature of the UF6 cylinder 2, for example based on a relationship between the temperature of the fluid 11 and the temperature of the cylinder 2 which is stored in the memory 20A. The controller 20 may monitor the temperature of the fluid 11 using temperature sensors (not shown) located in the looped heat exchange path 17. Such sensors may be located, for example, in the heating medium containing region 13 of the thermal guide 10, in the heat exchanger 18 and/or in the fluid circulation line 19.

The controller 20 may be comprised within a Plant Control System which, in addition to monitoring and controlling the temperature and pressure of the UF6 cylinders 2 as referred to above, is additionally configured to monitor and control other aspects of the enrichment facility.

The thermal guide 10 is formed of a relatively lightweight material so that it can be easily and quickly fitted to (and removed from) the UF6 cylinders 2. An example material is a cross-linked polymer, such as cross-linked polyethylene (e.g. PEX, PEX-Al-PEX and PERT), although alternative materials such as polybutylene could be used. The main body of the guide 10 may be bordered by a further heat insulating material at the heat insulating surface 14, such as a flexible microporous ceramics panel, in order to improve the thermally insulating properties of the heat insulating surface 14.

Figure 10:
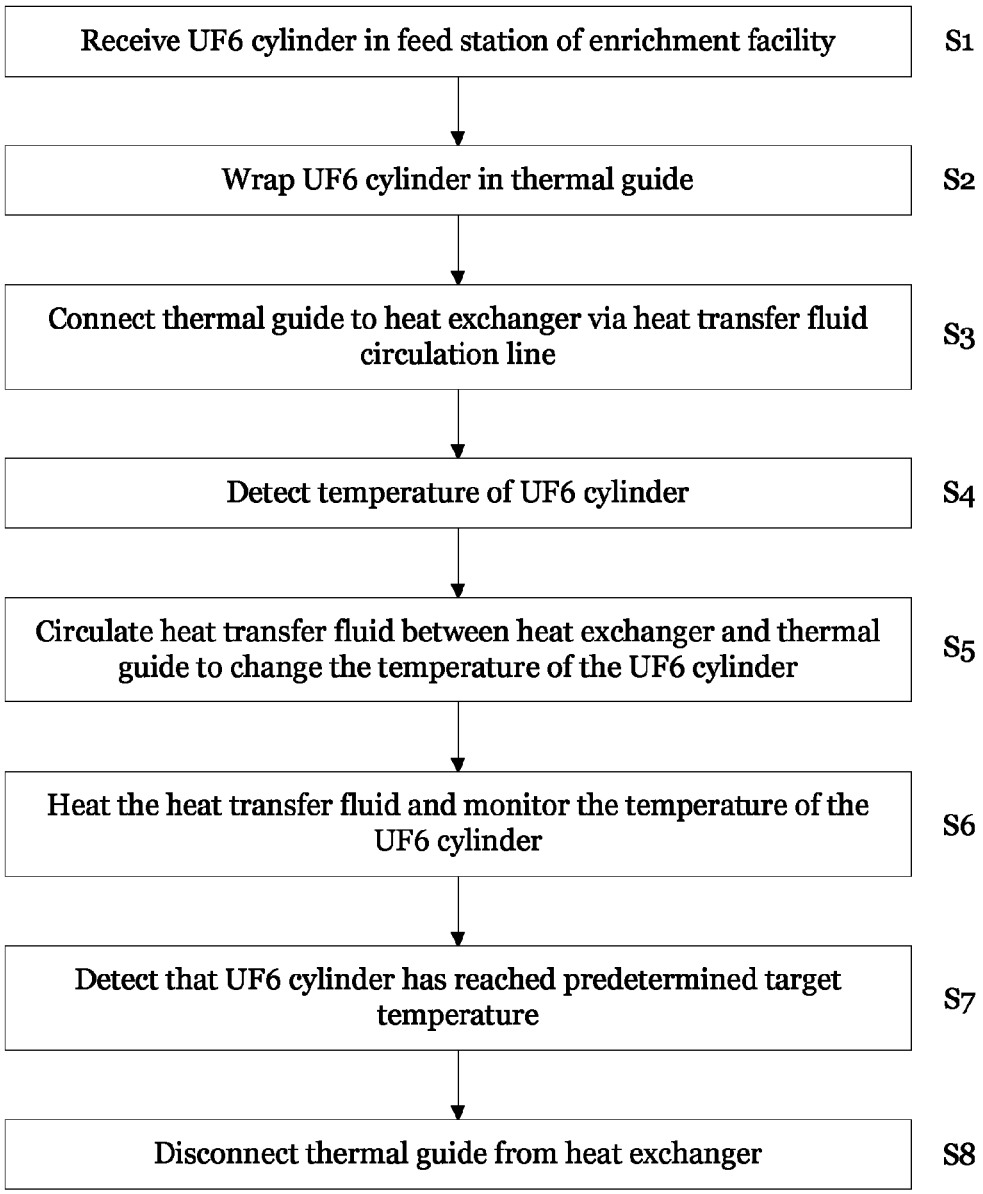
FIG. 10 is a flow diagram of a method of using a thermal energy transfer apparatus to heat solid UF6 in a 48Y UF6 storage and transport cylinder.

An example method of using the thermal energy transfer apparatus 1 is described below with respect to FIG. 10.

In a first step S1, a 48Y UF6 cylinder 2 containing UF6 which is of a natural or depleted concentration of U235 is received in a uranium material feed station of a uranium enrichment facility. The UF6 inside the cylinder 2 is in a solid state because the cylinder 2 has been stored at normal atmospheric temperatures of below 35° C. The UF6 is to be fed into an enrichment apparatus in which the UF6 must be in a gaseous state.

In a second step S2, the 48Y UF6 cylinder 2 is wrapped in the thermal guide 10 of the thermal energy transfer apparatus 1. In the case of the 48Y cylinder 2, the thermal guide 10 comprises a plurality of sections 10A-F as described previously. The dimensions of the thermal guide 10 are matched to the length, diameter and circumference of the exterior of the 48Y cylinder 2 so that the thermal guide 10 fits around the cylinder 2 to surround it. The heat transfer surface 12 of the thermal guide 10 is in continuous contact with the exterior surfaces 7, 8 of the cylinder 2 to form a continuous thermally conductive contact patch around the cylinder 2 and over its ends.

In a third step S3, the thermal guide 10 is connected to the heat transfer fluid circulation line 19. This allows heat transfer fluid 11 to flow from the circulation line 19 into the heat transfer medium containing region 13 of the thermal guide 10. The guide 10 may, for example, comprise a plurality of openings which are connectable to the circulation line 19 to receive heat transfer fluid 11 from the heat exchanger 18.

In a fourth step S4, the temperature of the 48Y UF6 cylinder 2 is detected by the controller 20 using the temperature sensors 21 described previously. This allows the controller 20 to establish the amount of heating that will be required to convert the solid UF6 inside the 48Y cylinder 2 into a gaseous form.

In a fifth step S5, the heat transfer fluid 11 is circulated around the looped heat exchange path 17 comprising the heat exchanger 18 and the thermal guide 10. This causes the heat transfer fluid 11 to pass from the heat exchanger 18 into the thermal guide 10 and back to the heat exchanger 18. In the thermal guide 10, the heat transfer fluid 11 is exposed to the temperature of the 48Y UF6 cylinder 2 through the thermally conductive heat transfer surface 12 of the guide 10. This causes heat exchange to take place between the heat transfer fluid 11 and the 48Y UF6 cylinder 2. Specifically, heat energy in the heat transfer fluid 11 conducts through the heat transfer surface 12 into the 48Y UF6 cylinder 2 and causes the temperature of the UF6 inside the cylinder 2 to increase.

In a sixth step S6, the controller 20 continuously monitors the temperature of the 48Y UF6 cylinder 2 as the heat transfer fluid 11 is circulated. The controller 20 adjusts the level to which the heat transfer fluid 11 is heated in the heat exchanger 18 in order to obtain a target temperature for the cylinder 2 based on feedback from the temperature sensors 21. The controller 20 causes the heat exchanger 18 to heat the heat transfer fluid 11 to a temperature which is sufficient to continually raise the temperature of the 48Y UF6 cylinder 2. The rate at which the UF6 is heated may be varied by the controller 20, for example so as to cause an initial rapid rate of heating followed by a more gradual rate of heating as the UF6 cylinder 2 approaches the target temperature.

In a seventh step S7, the controller 20 detects that the UF6 cylinder 2 has been heated to the target temperature. The target temperature is below the triple point of UF6 (64° C.), as previously described, but is sufficient for all of the UF6 inside the cylinder 2 to be in a gaseous state.

In an eighth step S8, the thermal guide 10 is decoupled from the heat transfer fluid circulation line 19 and unwrapped from the 48Y UF6 cylinder 2. This involves releasing the quick release connectors 16, referred to previously, and may also involve draining the thermal guide 10 of heat transfer medium 11 so that it is lighter and easier to manipulate during removal from the UF6 cylinder 2. The thermal energy transfer apparatus 1 is now ready to be used to heat another 48Y cylinder 2 of UF6.

Figure 11:
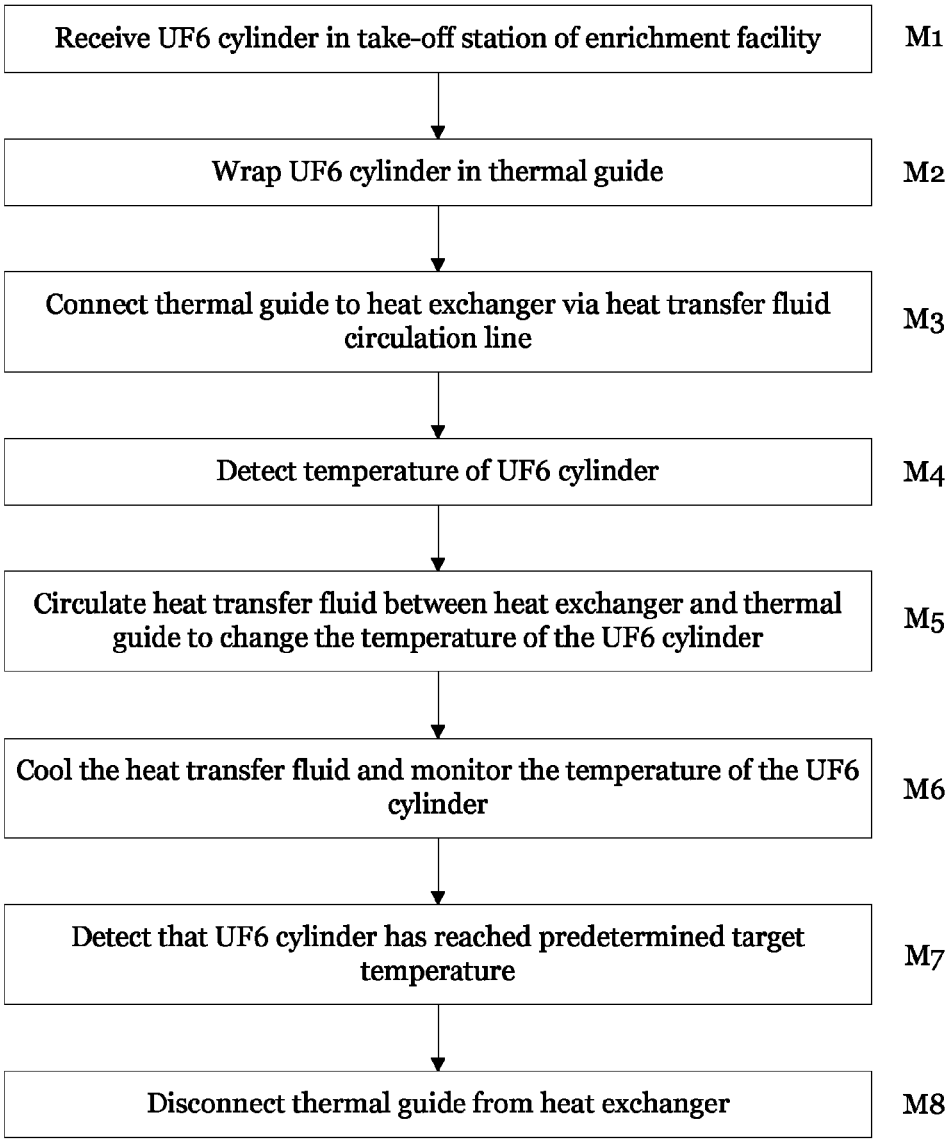
FIG. 11 is a flow diagram of a method of using a thermal energy transfer apparatus to cool gaseous UF6 in a 30B UF6 storage and transport cylinder.

Another example method of using the thermal energy transfer apparatus 1 is described below with respect to FIG. 11.

In a first step M1, a 30B UF6 cylinder 2 ready to receive UF6 which has been enriched in its concentration of U235 is received in a uranium material take-off station of a uranium enrichment facility. The UF6 is fed into the cylinder 2 in a gaseous state because the UF6 has been enriched in a gaseous state in the enrichment apparatus. It is desirable to cool the UF6 in order to return it to a solid state.

In a second step M2, the 30B UF6 cylinder 2 is wrapped in the thermal guide 10 of the thermal energy transfer apparatus 1. In the case of the 30B cylinder 2, the thermal guide 10 may comprises a single longitudinal section and two separate end sections, since the 30B cylinder 2 does not comprise the ribs 9 illustrated in the figures. The dimensions of the thermal guide 10 are matched to the length, diameter and circumference of the exterior of the 30B cylinder 2 so that the thermal guide 10 fits around the cylinder 2 to surround it. The heat transfer surface 12 of the thermal guide 10 is in continuous contact with the exterior surfaces 7, 8 of the cylinder 2 to form a continuous thermally conductive contact patch around the cylinder 2 and over its ends.

The third step M3 is the same as that described above in relation to the first method. The thermal guide 10 is connected to the heat transfer fluid circulation line 19, which allows heat transfer fluid 11 to flow from the circulation line 19 into the heat transfer medium containing region 13 of the thermal guide 10. It will be appreciated that the second and third steps M2, M3 may be carried out before UF6 is fed into the cylinder 2 from the enrichment apparatus.

In a fourth step M4, the temperature of the 30B UF6 cylinder 2 is detected by the controller 20 using the temperature sensors 21 described previously. This allows the controller 20 to establish the amount of cooling that will be required to convert the gaseous UF6 inside the 30B cylinder 2 into a solid state.

The fifth step M5 is the same as the fifth step S5 described previously, apart from that the temperature of the heat transfer fluid 11 is lower, rather than higher, than the temperature of the UF6 cylinder 2. This causes heat energy in the 30B UF6 cylinder 2 to conduct through the heat transfer surface 12 into the heat transfer fluid 11 and causes the temperature of the UF6 inside the cylinder 2 to decrease.

The sixth step M6 is also similar to the sixth step S6 described above. The controller 20 continuously monitors the temperature of the 30B UF6 cylinder 2 as the heat transfer fluid 11 is circulated, and the controller 20 may adjust the level to which the heat transfer fluid 11 is cooled in the heat exchanger 18 in order to obtain a target temperature for the UF6 cylinder 2 based on feedback from the temperature sensors 21. The controller 20 causes the heat exchanger 18 to cool the heat transfer fluid 11 to a temperature which is sufficient to continually lower the temperature of 30B UF6 cylinder 2.

In a seventh step M7, the controller 20 detects that the 30B UF6 cylinder 2 has been cooled to the target temperature. The target temperature is sufficient for all of the UF6 inside the cylinder 2 to be in a solid state.

In an eighth step M8, the thermal guide 10 is decoupled from the heat transfer fluid circulation line 19 and unwrapped from the 30B UF6 cylinder 2. The thermal energy transfer apparatus 1 is now ready to be used to cool another 30B cylinder 2 of UF6.

The cylinder 2 shown in the figures is a 48Y UF6 cylinder 2, but it will be appreciated that, with the exception of the ribs 9, the features described with respect to the figures also apply to 30B UF6 cylinders 2 and other types of industry-standardized UF6 containers 2. Similarly, although the example methods and apparatus 1 have been described in the context of heating UF6 in a 48Y cylinder 2 and cooling UF6 in a 30B cylinder 2, the method steps and apparatus 1 could alternatively be used to heat or cool uranium material such as UF6 in any suitable uranium material container 2. For example, the method steps and apparatus 1 described above could be used to heat UF6 in a 30B cylinder 2 and/or to cool UF6 in a 48Y cylinder 2.

The apparatus 1 has generally been described in the context of heating UF6 for supply to an enrichment apparatus and for cooling UF6 received from an enrichment apparatus. However, the method steps and apparatus 1 described above could alternatively, or additionally, be used to heat and/or cool UF6 in the cylinders 2 during UF6 blending operations to achieve a desired U235 concentration. The method steps and apparatus 1 could also be used to heat and/or cool UF6 cylinders 2 during UF6 recovery operations, for example in which UF6 is recovered from a damaged or outdated cylinder 2 and transferred into a new cylinder 2.

The thermal energy transfer apparatus 1 described herein provides a heating and cooling process which is energy efficient. It also provides a process in which the temperature of the uranium material can be controlled accurately and in which desired changes to the temperature can be effected in a short period of time.

The invention claimed is:

1. An apparatus arranged to control a temperature of uranium material in a uranium material storage container, comprising:

a thermal guide which wraps around an external surface of the uranium material storage container to cause a heat transfer medium inside the thermal guide to exchange heat energy with the uranium material storage container;

a heat exchanger to heat or cool the heat transfer medium outside the thermal guide; and wherein the thermal guide comprises selectively releasable connections which attach the thermal guide to the uranium material storage container.

2. An apparatus according to claim 1, wherein the thermal guide forms a thermally conductive contact with the uranium material storage container to cause the exchange of heat energy by conduction.

3. An apparatus according to claim 1, wherein the thermal guide is configured to guide the heat transfer medium around an exterior of the uranium material storage container.

4. An apparatus according to claim 1, wherein the thermal guide surrounds the uranium material storage container.

5. An apparatus according to claim 1, wherein the thermal guide comprises a thermally conductive heat transfer surface for locating against the external surface of the uranium material storage container and through which heat energy is exchanged between the heat transfer medium in the guide and the uranium material storage container.

6. An apparatus according to claim 1, wherein the thermal guide comprises a heat insulating surface which is configured to prevent heat transfer between the heat transfer medium in the guide and the atmosphere around the uranium material storage container.

7. An apparatus according to claim 1, configured to controllably heat or cool the heat transfer medium in order to cause heating or cooling of the uranium material inside the uranium material storage container.

8. An apparatus according to claim 1, configured to detect the temperature of the uranium material storage container and to heat or cool the heat transfer medium in response to the detected value of the temperature of the uranium material storage container.

9. An apparatus according to claim 1, configured to heat or cool the heat transfer medium to obtain a predetermined target temperature for the uranium material storage container.

10. An apparatus according to claim 1, wherein the thermal guide comprises a plurality of sections which wrap around a corresponding plurality of regions of the uranium material storage container.

11. An apparatus according to claim 1 arranged to circulate the heat transfer medium between the thermal guide and the heat exchanger to heat or cool the heat transfer medium.

12. An apparatus according to claim 1, comprising a further thermal guide which wraps around an external surface of a further uranium material storage container to cause a heat transfer medium inside the further thermal guide to exchange heat energy with the further uranium material storage container, wherein the heat exchanger is configured to cause heat energy extracted from a warmer of the storage containers to be transferred to a cooler of the storage containers.

13. A uranium material storage container wrapped in a thermal guide of an apparatus according to claim 1.

14. A method of controlling a temperature of uranium material in a uranium material storage container, comprising:

wrapping the uranium material storage container in a thermal guide of an apparatus arranged to control the temperature of uranium material in the uranium material storage container, wherein the thermal guide comprises selectively releasable connections which attach the thermal guide to the uranium material storage container; and using a heat exchanger of the apparatus to heat or cool a heat transfer medium outside the thermal guide to cause the heat transfer medium to exchange heat energy with the uranium material storage container when inside the guide.

15. The apparatus according to claim 1, wherein the thermal guide is flexible and configured to be wrapped around, and unwrapped from, a cylindrical surface of the uranium material storage container, and the thermal guide is connected to the heat exchanger by a circulation line.

16. The apparatus of claim 15, wherein the uranium material storage container is one of a 48Y UF6 storage and transport cylinder or a 30B UF6 cylinder, and the thermal guide is sized to extend around a full circumference of the uranium material storage container.

17. The method of claim 14, wherein the thermal guide is flexible, wherein the wrapping comprises wrapping the thermal guide around a cylindrical surface of the uranium material storage container, and further comprising:

unwrapping the thermal guide from around a cylindrical surface of the uranium material storage container.

18. The method of claim 17, wherein the uranium material storage container is one of a 48Y UF6 storage and transport cylinder or a 30B UF6 cylinder, and the thermal guide is sized to extend around a full circumference of the uranium material storage container.

* * * * *